United States Patent [19]

Jereckos

[11] 4,304,213

[45] Dec. 8, 1981

[54] AIR GUN AND PRESSURE RELIEF VALVE THEREFOR

[75] Inventor: James R. Jereckos, Webster, N.Y.

[73] Assignee: The Coleman Company, Inc., Wichita, Kans.

[21] Appl. No.: 130,553

[22] Filed: Mar. 14, 1980

[51] Int. Cl.[2] ..... F41B 11/00

[52] U.S. Cl. ..... 124/69; 124/70

[58] Field of Search ..... 124/69, 73, 74, 75, 124/76, 77, 70; 251/367; 137/538

[56] References Cited

U.S. PATENT DOCUMENTS

| | | | |
|---|---|---|---|
| 1,486,215 | 3/1924 | Zerbee | 124/69 |
| 3,068,894 | 12/1962 | Bunting et al. | 137/538 |
| 3,303,831 | 2/1967 | Sherman | 137/538 X |
| 4,091,791 | 5/1978 | Castelli et al. | 124/73 |
| 4,173,964 | 11/1979 | Curran | 124/74 X |

*Primary Examiner*—Richard T. Stouffer

[57] ABSTRACT

A pressure relief valve for an air gun limits the maximum muzzle velocity of the gun without losing an excessive amount of pressure. The valve includes a valve housing which is provided with an intake orifice, a chamber, and a discharge orifice. A check valve in the chamber normally closes the intake orifice. The intake orifice communicates with the pressure reservoir of the gun, and, when excessive pressure builds up within the pressure reservoir, the check valve opens to relieve the excess pressure.

4 Claims, 2 Drawing Figures

AIR GUN AND PRESSURE RELIEF VALVE THEREFOR

BACKGROUND AND SUMMARY

This invention relates to a pressure relief valve for pneumatic powered guns, and, more particularly, to a pressure relief valve which prevents excessive loss of pressure when air is vented to limit the maximum muzzle velocity.

A pneumatic or air powered gun conventionally includes a pressure reservoir for storing pressurized air and firing means for releasing the pressurized air to propel a projectile out of the barrel. Pressure is usually built up in the reservoir by a hand pump mounted on the gun, and the pressure in the reservoir is increased each time the pump is operated. However, variations in the amount of pumping affect the performance of the gun. Excessive muzzle velocity caused by over-pumping violates government regulations in some jurisdictions. Excessive pressure also causes abnormal wear and damage to components of the gun. Over-pumping can also result in all of the pressure not being released when the gun is fired, and an unexpected discharge might occur without the gun being pumped if the trigger is again pulled. Under-pumping creates a weak muzzle velocity and inaccurate shots.

Pressure relief valves have been employed to control the maximum pressure in guns and other devices. For example, U.S. Pat. Nos. 1,486,215, 3,025,633, and 3,680,540 disclose valves for shunting air away from the projectile to reduce muzzle velocity when the pressure reaches a certain limit. However, performance can be affected by surging and the resulting excessive loss of pressure. For example, assume that it is desired to limit the pressure to that which provides a muzzle velocity of 500 feet per second (fps). The last pump which increases the pressure over the desired maximum will open the pressure relief valve, and sufficient pressure might escape before the valve closes to reduce the muzzle velocity substantially below 500 fps. The resulting low pressure not only causes low muzzle velocity but can also cause jamming.

The invention controls maximum muzzle velocity of the gun while minimizing surging and loss of excessive amounts of pressure. A check valve includes a spring-biased plunger which fits relatively snuggly in the housing of the check valve and which normally closes the air inlet of the check valve. The valve housing has a relatively small air outlet orifice which creates backpressure when the plunger moves away from the air inlet. The backpressure and the snug fit between the plunger and the valve housing restrain movement of the plunger and permit the spring to return the plunger to its sealing position almost immediately after the pressure in the gun falls below the desired maximum.

DESCRIPTION OF THE DRAWING

The invention will be explained in conjunction with an illustrative embodiment shown in the accompanying drawing, in which.

DESCRIPTION OF SPECIFIC EMBODIMENT

The numeral 10 designates generally an air rifle which includes a frame or receiver 11, a stock 12 secured to the receiver, and a barrel 13. The rifle is a conventional air gun with the exception of the pressure relief valve, and only a brief description of the gun is necessary for an understanding of the invention.

Figure 2:
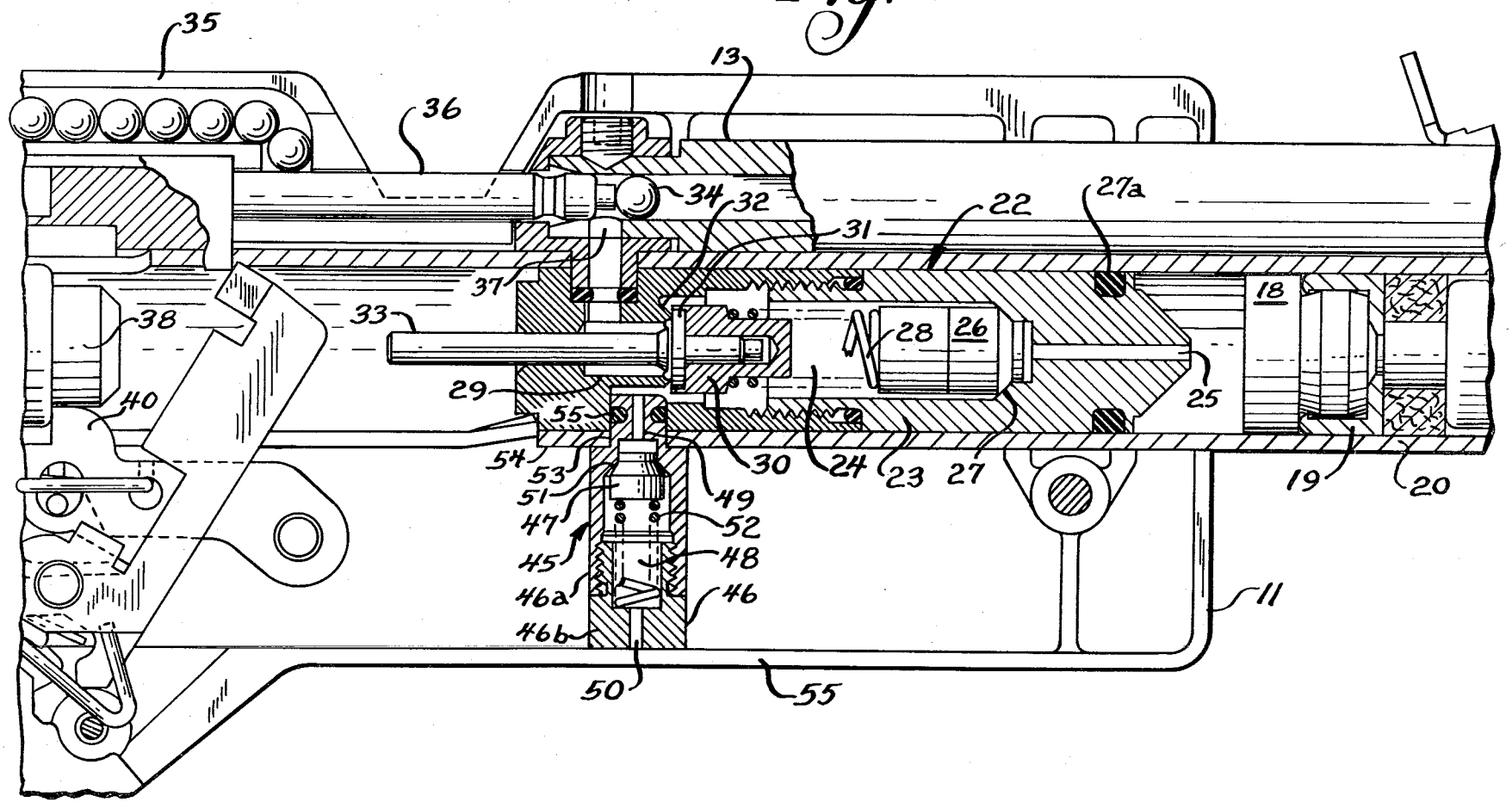
FIG. 2 is an enlarged fragmentary sectional view of a portion of FIG. 1 showing the details of the pressure relief valve.

Air pressure is built up within the gun by a hand pump assembly 14. A hand grip 15 is pivotally secured to the receiver by a pin 16, and a link 17 is pivotally secured to the hand grip and to a piston 18 (see also FIG. 2). A gasket 19 (FIG. 2) is carried by the piston and sealingly engages the wall 20 of a pumping chamber which is provided by the internal structure of the receiver.

A valve assembly 22 is mounted in the receiver for storing pressurized air until the gun is fired. The valve assembly includes a valve body 23 which is mounted within the chamber wall 20 and which is provided with a pressure reservoir or chamber 24. The end of the valve body which faces the piston 18 is provided with an air inlet 25, and the inlet is normally closed by a nylon plug or plunger 26 which is resiliently biased against a conical seat 27 within the valve body by a spring 28. An O-ring **27*a* provides an air seal between the inlet end of the valve body and the chamber wall 20**.

A discharge port 29 in the other end of the valve body is normally closed by a plunger 30 which is also resiliently biased by the spring 28. The plunger 30 includes a resilient sealing ring 31 which engages a valve seat 32 on the valve body and a stem 33 which extends through the valve body for engagement by the firing mechanism of the gun.

The reservoir within the valve body 23 is pressurized by reciprocating the piston 18 by pivoting the hand grip 15. Each time the piston is moved toward the valve body, air is compressed by the piston and forced past the plug 27 into the pressure reservoir. The pressure within the reservoir is thereby increased each time the hand grip is pumped.

A BB 34 (FIG. 2) is shown in the firing position in the breech end of the barrel 13. The BB is loaded from a magazine 35 by a bolt 36, and the bolt positions the BB just forwardly of an air port 37 which communicates with the discharge port of the valve body.

Figure 1:
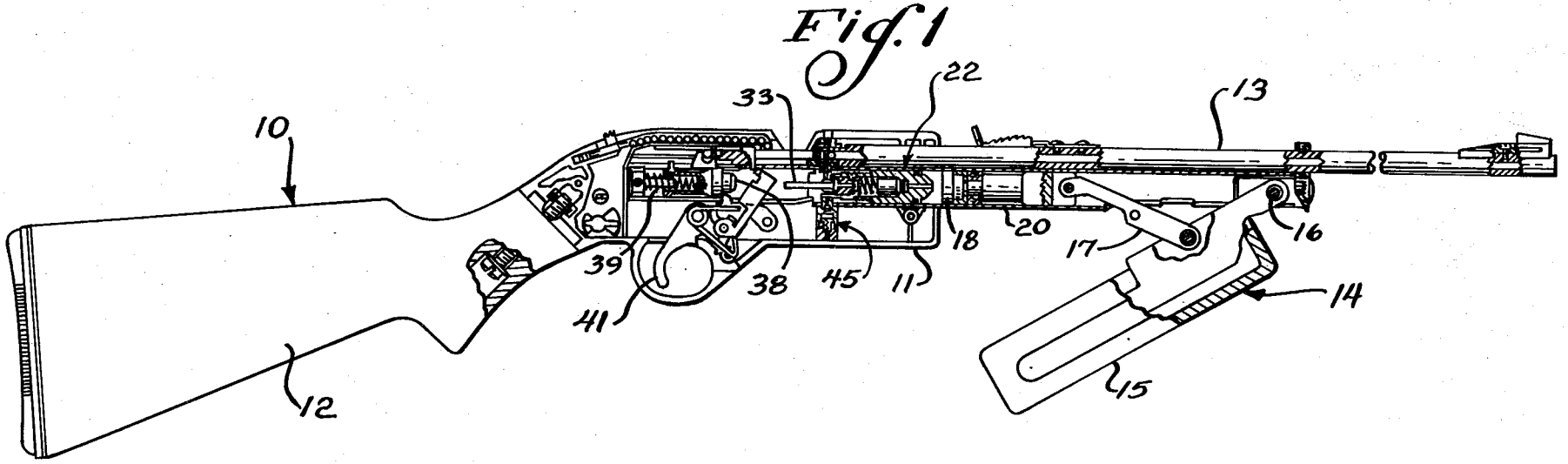
FIG. 1 is a side elevational view, partially broken away, of an air gun equipped with a pressure relief valve formed in accordance with the invention.

The firing mechanism includes a firing plunger 38 which is resiliently biased to the right by a firing spring 39 (FIG. 1). The firing plunger is shown in its cocked position in which it compresses the firing spring and is held by a sear 40. The sear is pivotable by a trigger 41 (FIG. 1) for releasing the plunger, and the firing spring drives the plunger toward the valve stem 33. When the valve stem 33 is moved to the right, the sealing ring 31 is inserted from the valve seat 32, and pressurized air flows from the reservoir through the port 37 to propel the BB.

The structure and operation of the gun as heretofore described in conventional. It will be understood that the velocity at which the BB or other projectile is fired from the gun depends upon the air pressure within the pressure reservoir when the gun is fired. Each time the pump assembly is pumped, the pressure is increased and the projectile will be fired with greater velocity.

The invention limites the velocity at which the projectile will be fired by limiting the pressure which can be stored within the pressure reservoir. A pressure relief valve assembly 45 includes a valve housing 46 and a Teflon plug or plunger 47 which is reciprocable within an internal chamber 48 in the valve housing. The upper end of the valve housing is provided with an air inlet orifice 49 which communicates with the pressure reservoir 24, and the lower end of the valve housing has an air outlet orifice 50 through which air is discharged to the atmosphere. The plug 47 is resiliently biased against a conical valve seat 51 by a coil spring 52 for sealing the air inlet orifice. The valve housing is formed by an upper portion 46*a* and a lower portion 46*b* which are threadedly connected after the plug and spring are inserted into the upper portion 46*a*.

The upper end of the valve housing has a reduced-diameter neck portion 53 which extends through an opening in a shelf 54 of the receiver and though an opening in the valve body 23. An O-ring 55 provides an air seal between the neck portion and the valve body. The lower end of the valve housing is supported by the bottom wall 55 of the receiver. The receiver is conventionally formed from a pair of mating halves, and the pressure relief valve assembly is assembled to the valve block merely by inserting the neck portion into the valve block and closing the receiver halves. The valve housing is thereby secured between the receiver wall 54 and 55.

The spring constant of the spring 52 is selected so that the plug 47 will maintain the inlet orifice of the pressure relief valve closed until the pressure within the pressure reservoir exceeds the desired maximum pressure. For example, it may be desired to limit the maximum muzzle velocity of the projectile to 500 fps. The spring is selected so that the plug 47 will open the inlet orifice when the pressure within the pressure reservoir exceeds the pressure which is needed to provide a muzzle velocity of 500 fps.

The air outlet orifice 50 of the pressure relief valve is substantially smaller than the width of the internal chamber 48 of the valve housing. The air outlet orifice therefore restricts air flow from the chamber and creates backpressure within the chamber. This backpressure assists in closing the plug 47 after the pressure within the pressure reservoir falls below the desired maximum. The restricted air flow through the air outlet and the backpressure minimize the amount of pressure which is lost before the pressure relief valve closes. The plug is advantageously sized to fit relatively snuggly within the valve housing, and the snug fit between the plug and the valve housing also restricts the rate at which pressurized air can escape from the pressure reservoir.

As an example, assume that the pressure within the pressure reservoir is sufficient to provide a muzzle velocity of 495 fps. Another stroke of the pumping assembly will cause the pressure to exceed a muzzle velocity of 500 fps, and the pressure relief valve will open. The substantial pressure within the pressure reservoir will attempt to surge past the plug of the pressure relief valve, and, without the inventive pressure relief valve, sufficient pressure might escape before the plug can close so that the pressure would be substantially reduced below a muzzle velocity of 500 fps. The inventive pressure relief valve inhibits surging and minimizes loss of pressure below the desired maximum before the pressure relief valve closes.

While in the foregoing specification a detailed description of a specific embodiment of the invention was set forth for the purpose of illustration, it will be understood that many details herein given may be varied considerably by those skilled in the art without departing from the spirit and scope of the invention.

I claim:

1. In an air gun having a frame, the frame comprising a pair of mating halves and having an upper and a lower wall, a barrel mounted on the frame, a valve body mounted on the frame above said upper wall and having a pressure reservoir for storing pressurized air, pump means for supplying pressurized air to the pressure reservoir, and firing means for releasing pressurized air from the pressure reservoir to the barrel for propelling a projectile out of the barrel, the improvement comprising a pressure relief valve for preventing the pressure in the pressure reservoir from exceeding a desired maximum pressure, the pressure relief valve comprising a valve housing positioned between said upper and lower frame walls and including a reduced-diameter neck portion which extends through said upper frame wall into an opening in the valve body, an O-ring surrounding the neck portion for providing a seal between the neck portion and the valve body, said valve housing having an inlet communicating with the pressure reservoir, a plunger chamber, and an outlet orifice, a plunger within the chamber, and spring means for resiliently biasing the plunger against the inlet for sealing the inlet until the pressure within the pressure reservoir overcomes the force exerted by the spring means.

2. The structure of claim 1 in which the width of the outlet orifice is substantially smaller than the width of the chamber to provide backpressure within the chamber when the plunger moves to permit pressurized air to flow from the pressure reservoir to the chamber.

3. The structure of claim 2 in which the plunger is sized to fit snuggly within the chamber to restrict air flow past the plunger.

4. The structure of claim 1 in which the plunger is sized to fit snuggly within the chamber to restrict air flow past the plunger.

* * * * *